US007092660B2

(12) United States Patent
Tanaka et al.

(10) Patent No.: US 7,092,660 B2
(45) Date of Patent: Aug. 15, 2006

(54) IMAGE FORMING APPARATUS

(75) Inventors: Kuniaki Tanaka, Nagano (JP); Keiichi Taguchi, Nagano (JP); Toshiya Takahata, Nagano (JP); Hiroshi Miyazawa, Nagano (JP); Nobuyuki Mizushima, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 244 days.

(21) Appl. No.: 10/854,024

(22) Filed: May 26, 2004

(65) Prior Publication Data

US 2005/0008415 A1 Jan. 13, 2005

(30) Foreign Application Priority Data

| | | |
|---|---|---|
| May 26, 2003 | (JP) | P2003-147794 |
| May 26, 2003 | (JP) | P2003-147795 |
| May 26, 2003 | (JP) | P2003-147796 |
| May 26, 2003 | (JP) | P2003-147797 |
| Jun. 4, 2003 | (JP) | P2003-158947 |

(51) Int. Cl.
*G03G 15/01* (2006.01)
*G03G 15/16* (2006.01)

(52) U.S. Cl. ..... 399/227; 399/302; 399/343

(58) Field of Classification Search ..... 399/227, 399/297, 302, 308, 101, 343, 350
See application file for complete search history.

(56) References Cited

U.S. PATENT DOCUMENTS

| | | | | |
|---|---|---|---|---|
| 4,707,108 A * | 11/1987 | Akio | ..... | 399/227 |
| 5,822,666 A * | 10/1998 | Haneda et al. | ..... | 399/101 |
| 5,966,564 A * | 10/1999 | Kizaki et al. | ..... | 399/297 |
| 6,768,892 B1 * | 7/2004 | Sawai | ..... | 399/302 |

FOREIGN PATENT DOCUMENTS

| | | |
|---|---|---|
| JP | 03-086376 | 8/1991 |
| JP | 05-127576 | 5/1993 |
| JP | 06-138799 | 5/1994 |
| JP | 11-038846 | 2/1999 |
| JP | 2000-214644 | 8/2000 |
| JP | 2000-284662 | 10/2000 |
| JP | 2001-042740 | 2/2001 |
| JP | 2001-100514 | 4/2001 |
| JP | 2001-134074 | 5/2001 |
| JP | 2001-134135 | 5/2001 |
| JP | 2001-175090 | 6/2001 |
| JP | 2001-281993 | 10/2001 |
| JP | 2002-082532 | 3/2002 |
| JP | 2003-066801 | 3/2003 |
| JP | 2004-348063 | 12/2004 |
| JP | 2004-348064 | 12/2004 |

* cited by examiner

*Primary Examiner*—Susan Lee
(74) *Attorney, Agent, or Firm*—Hogan & Hartson LLP

(57) ABSTRACT

An electrostatic latent image is formed on an image carrier. A developing roller is separatably abutted on the image carrier at a developing position to supply toner onto the image carrier to make the latent image visible as a toner image. The toner image is transferred onto a transfer member. A cleaner is abutted on the image carrier to remove toner remained thereon. A toner supplier supplies toner onto the image carrier while the developing roller is separated from the image carrier.

45 Claims, 16 Drawing Sheets

IMAGE FORMING APPARATUS

BACKGROUND OF THE INVENTION

The present invention relates to an image forming apparatus comprising: an image carrier on which an electrostatic latent image is formed; means for forming a latent image on the image carrier; means for developing the latent image by abutting a developing roller on the image carrier; means for transferring a toner image developed on the image carrier onto an intermediate transfer medium; and a cleaner, abutting on the image carrier, for removing post-transfer residual toner, wherein the developing roller spaced apart from the image carrier during a development color switching operation.

An image forming apparatus includes, around the periphery of a photosensitive body serving as a rotary image carrier, a charging device to charge the photosensitive body uniformly along the rotational direction thereof, an exposing device to form an electrostatic latent image on the photosensitive body, a developing device to develop an electrostatic latent image, a transferring device to transfer a toner image on the photosensitive body onto a transferring member, a cleaner to clean the surface of the post-transfer photosensitive body, etc. An electrostatic latent image formed on the photosensitive body by the exposing device is developed by the developing device to form a toner image. The toner image thus formed is transferred onto a transferring member and residual toner on the post-transfer photosensitive body is removed from the photosensitive body by the cleaner.

In a case of a rotary-type full-color image forming apparatus that forms a full-color image, color toner images, formed on the photosensitive body by the respective developing devices for yellow Y, magenta M, cyan C, and black K, are sequentially transferred onto an intermediate transferring member to superpose colors. For this reason, the developing cartridges of respective colors of toner are detachably mounted to a rotary development unit, and each time an electrostatic latent image of one color is formed on the photosensitive body, the rotary development unit is driven by a development color switching operation to move the developing cartridge of the corresponding toner by rotation to a developing position for a developing operation to be performed. Such a configuration is disclosed in Japanese Patent Publication Nos., 2002-82532A, and 2003-66801A, for example.

In an image forming apparatus, an outer circumferential surface of the photosensitive body is repetitively scanned in the axial direction thereof (primary scanning direction) to form an electrostatic latent image thereon while the photosensitive body is uniformly rotated. An exposing beam from the exposing device is modulated by an image forming signal. Therefore, when the rotations of the photosensitive body are unstable to cause vibrations and irregularities, there occurs a problem that the image quality is deteriorated due to banding, which appears, for example, in the form of a streak in the secondary scanning direction.

One of the factors that make rotations of the photosensitive body unstable to cause vibrations and irregularities is, besides the configuration of a gear train in the driving mechanism, the presence of the cleaner that abut on the photosensitive body along the periphery thereof.

The cleaner is to clean residual toner on the post-transfer photosensitive body after a toner image formed on the photosensitive body is transferred onto a transferring member. In order to enhance the cleaning effect, tho cleaner is abutted on the outer circumferential surface of the photosensitive body at a constant pressure by a spring or the like. A lower abutting pressure naturally reduces the cleaning effect; however, a higher abutting pressure becomes a factor that generates irregular vibrations associated with frictional sliding between the outer circumferential surface of the photosensitive body and the cleaner. In addition, the angle at which the blade abuts on the outer circumferential surface of the photosensitive body, the position of the supporting point, at which the cleaner is supported, with respect to the tangential line to the abutting surface, etc. have an influence on the cleaning effect.

Further, in contrast to an image forming apparatus in which the developing roller constantly abuts on the photosensitive body, in an image forming apparatus in which the developing roller is retracted from the developing position on the photosensitive body during the development color switching, it is observed that irregularities in rate of the photosensitive body readily occur. For example, in a rotary-type color image forming apparatus provided with the rotary development unit, the rotary development unit is rotated when the development color switching operation is performed while each of the developing rollers is sequentially brought into contact with the photosensitive body and spaced apart therefrom. Due to the repetition of the abutment and retraction, the outer circumferential surface of the photosensitive body cannot be maintained in the uniform state, and the cleaner is no longer able to undergo frictional sliding smoothly, which in turn makes a rate of the photosensitive body unstable.

SUMMARY OF THE INVENTION

It is therefore an object of the invention to provide an image forming apparatus which is capable of eliminating irregularities in an image induced by irregularities in the image carrier caused by frictional sliding with the cleaning member, and in particular, eliminating irregularities in an image induced by irregularities in the rotation velocity of the image carrier during the development color switching operation.

In order to achieve the above object, according to the invention, there is provided an image forming apparatus, comprising:

an image carrier, on which an electrostatic latent image is formed;

a developing roller, separatably abutted on the image carrier at a developing position to supply toner onto the image carrier to make the latent image visible as a toner image;

a transfer member, on which the toner image is transferred;

a cleaner, abutted on the image carrier to remove toner remained thereon; and a toner supplier, which supplies toner onto the image carrier while the developing roller is separated from the image carrier.

Preferably, the toner supplier is a circulator such as a rotary brush which returns the toner removed by the cleaner onto the image carrier.

Preferably, the toner supplier reversely transfers toner, which has been once transferred from the image carrier to the transfer member, from the transfer member to the image carrier. Here, the toner is reversely transferred onto a portion of the image carrier that passes the developing position while the developing roller is separated from the image carrier.

Preferably, the developing roller is mounted on a rotary unit operable to move the developing roller in a circumferential direction thereof, thereby separating the developing roller from the image carrier. Here, the rotary unit comprises a plurality of cartridges each of which contains one color of toner different from another and is provided with the developing roller.

Preferably, the cleaner comprises a blade member which is pivotable about a point situated further from the image carrier relative to a tangential line defined at an abutting point between the blade member and to the image carrier.

According to the invention, there is also provided an image forming apparatus, comprising:

an image carrier, on which an electrostatic latent image is formed;

a developing roller, separatably abutted on the image carrier at a developing position to supply toner onto the image carrier to make the latent image visible as a toner image;

a transfer member, on which the toner image is transferred;

a cleaner, abutted on the image carrier to remove toner remained thereon; and a lubricant supplier, which supplies lubricant onto the image carrier while the developing roller is separated from the image carrier.

Preferably, the lubricant supplier is a circulator such as a rotary brush which returns the toner removed by the cleaner onto the image carrier as the lubricant.

Preferably, the lubricant supplier is a boater which directly coats the lubricant including zinc stearate onto the image carrier.

Preferably, the lubricant supplier reversely transfers toner, which has been once transferred from the image carrier to the transfer member, from the transfer member to the image carrier as the lubricant. Here, the toner is reversely transferred onto a portion of the image carrier that passes the developing position while the developing roller is separated from the image carrier.

Preferably, the developing roller is mounted on a rotary unit operable to move the developing roller in a circumferential direction thereof, thereby separating the developing roller from the image carrier. Here, the rotary unit comprises a plurality of cartridges each of which contains one color of toner different from another and is provided with the developing roller.

Preferably, the cleaner comprises a blade member which is pivotable about a point situated further from the image carrier relative to a tangential line defined at an abutting point between the blade member and to the image carrier.

According to the invention, there is also provided an image forming apparatus, comprising:

an image carrier, on which an electrostatic latent image is formed;

a developing roller, separatably abutted on the image carrier at a developing position to supply toner onto the image carrier to make the latent image visible as a toner image, a first transfer member, on which the toner image is primarily transferred; and a first cleaner, abutted on the image carrier to remove toner remained thereon, wherein a dummy toner image is formed on a portion of the first transfer member which faces a portion of the image carrier that passes the developing position while the developing roller is separated from the image carrier.

Preferably, the dummy toner image is formed periodically or every time when the toner image is formed in a predetermined number of times.

Preferably, the dummy toner image is an image in which a plurality of lines or dots are arrayed with a fixed interval.

Preferably, the dummy toner image is reversely transferred onto the portion of the image carrier that passes the developing position while the developing roller is separated from the image carrier.

Preferably, the image forming apparatus further comprises: a second transfer member, which secondarily transfer the toner image from the first transfer member onto a recording medium; and a second cleaner, operable to remove toner remained on the first transfer member. Here, the second cleaner is separated from the first transfer member so as to avoid the dummy toner image.

Preferably, the developing roller is mounted on a rotary unit operable to move the developing roller in a circumferential direction thereof, thereby separating the developing roller from the image carrier. Here, the rotary unit comprises a plurality of cartridges each of which contains one color of toner different from another and is provided with the developing roller.

Preferably, the first cleaner comprises a blade member which is pivotable about a point situated further from the image carrier relative to a tangential line defined at an abutting point between the blade member and to the image carrier.

According to the invention, there is also provided an image forming apparatus, comprising:

an image carrier;

a latent image former, which forms an electrostatic latent image on the image carrier;

a developing roller, separatably abutted on the image carrier at a developing position to supply toner onto the image carrier to make the latent image visible as a toner image;

a first transfer member, on which the toner image is primarily transferred;

a first cleaner, abutted on the image carrier to remove toner remained thereon; and a toner supplier, which supplies toner onto the image carrier such that the supplied toner is placed on a portion of the image carrier at which the first cleaner is abutted when the latent image former starts to form the latent image.

Preferably, the toner supplier supplies the toner while the developing roller is separated from the image carrier.

Preferably, the supplied toner is a dummy toner image formed on the first transfer member.

Preferably, the image forming apparatus further comprises: a second transfer member, which secondarily transfer the toner image from the first transfer member onto a recording medium; and a second cleaner, operable to remove toner remained on the first transfer member. Here, the second cleaner is separated from the first transfer member so as to avoid the dummy toner image.

Preferably, the toner supplier is a circulator such as a rotary brush which returns the toner removed by the first cleaner onto the image carrier.

Preferably, the developing roller is mounted on a rotary unit operable to move the developing roller in a circumferential direction thereof, thereby separating the developing roller from the image carrier. Here, the rotary unit comprises a plurality of cartridges each of which contains one color of toner different from another and is provided with the developing roller.

Preferably, the first cleaner comprises a blade member which is pivotable about a point situated further from the image carrier relative to a tangential line defined at an abutting point between the blade member and to the image carrier.

According to the invention, there is also provided an image forming apparatus, comprising:

a rotary image carrier;

a latent image former, which forms an electrostatic latent image on the image carrier;

a developing roller, separatably abutted on the image carrier at a first circumferential position thereof to supply toner onto the image carrier to make the latent image visible as a toner image;

a transfer member, on which the toner image is transferred;

a cleaner, abutted on the image carrier at a second circumferential position thereof to remove toner remained thereon; and a controller, which causes the latent image former to start to form the latent image after the toner supplied from the developing roller reaches the second circumferential position.

Preferably, the controller includes a detector which detects whether the toner is absent at the second circumferential position. Here, the controller inhibits the latent image formation when the detects that the toner is absent at the second circumferential position.

It is preferable that the detector detects whether the toner is absent at the first portion based on a fact that the developing roller is abutted on a portion of the image carrier placed at the second circumferential position when the portion was placed at the first circumferential position.

It is also preferable that the detector detects whether the toner is absent at the first portion based on a fact that a dummy toner image is formed on a portion of the transfer member that opposes a portion of the image carrier which was placed at the first circumferential position while the developing roller is separated from the image carrier.

Preferably, the developing roller is mounted on a rotary unit operable to move the developing roller in a circumferential direction thereof, thereby separating the developing roller from the image carrier. Here, the rotary unit comprises a plurality of cartridges each of which contains one color or toner different from another and is provided with the developing roller.

Preferably, the first cleaner comprises a blade member which is pivotable about a point situated further from the image carrier relative to a tangential line defined at an abutting point between the blade member and to the image carrier.

BRIEF DESCRIPTION OF THE DRAWINGS

The above objects and advantages of the present invention will become more apparent by describing in detail preferred exemplary embodiments thereof with reference to the accompanying drawings, wherein:

FIG. 16 is a diagram for explaining a timing control of a latent image formation.

DETAILED DESCRIPTION OF THE INVENTION

Embodiments of the invention will be described below in detail with reference to the accompanying drawings.

Figure 1:
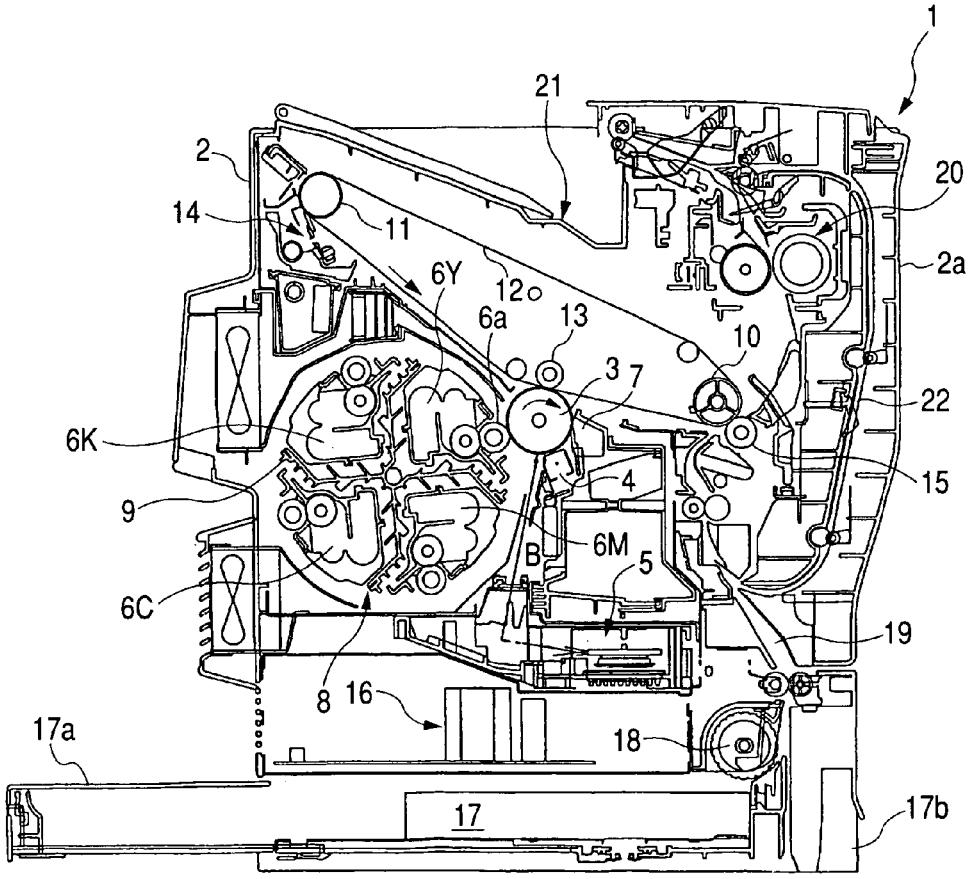
FIG. 1 is a section view showing an image forming apparatus according to one embodiment of the invention.

As shown in FIG. 1, an image forming apparatus according to one embodiment of the invention comprises a body casing 2 provided with a sheet discharging tray 21 formed at the top portion thereof and a front door cover 2*a*. In the body casing 2, there are disposed a rotary development unit 8 in which plural toner cartridges 6C, 6M, 6Y, 6K are detachably mounted, a photosensitive body 3 on which an electrostatic latent image is formed and a toner image is developed, an intermediate transfer unit onto which the toner image on the photosensitive body 3 is transferred, a control unit to control respective driving motors and bias voltages, a power supply 16, a sheet feeding tray 17 containing recording media (e.g., sheets of paper), a fixing unit 20 to fix a toner image on a recording medium, etc. Also, inside the front cover 2*a* is provided a sheet transportation unit 22 to transport a recording medium from the sheet feeding tray 17 to (the fixing unit 20 through a secondary transfer roller 15. In addition, each unit is detachably provided in the main body, so that each unit is independently repaired or replaced during a maintenance work.

The photosensitive body 3, serving as an image carrier, includes a conductive base material of a thin cylindrical shape, and a photosensitive layer formed on the surface thereof. Around the periphery of the photosensitive body 3 are provided a charging device 4 to uniformly charge the outer circumferential surface of the photosensitive body 3, an exposing device (or a writing device) 5 to form an electrostatic latent image on the photosensitive body 3, the rotary development unit 8 to develop the electrostatic latent image, an intermediate transfer belt 12 onto which the toner image on the photosensitive body 3 is primarily transferred, the intermediate transfer unit to perform primary transfer for the toner image to be transferred onto the intermediate transfer belt 12, a cleaner 7 to clean the surface of the photosensitive body 3 after the primary transfer is performed.

The intermediate transfer unit comprises: a driving roller 10; a follower roller 11; the intermediate transfer belt 12, which is an endless belt stretched by these rollers 10 and 11 and is circulated in a direction indicated by an arrow in FIG. 1; a primary transfer roller 13, provided oppositely to the photosensitive body 3 on the back side of the intermediate transfer belt 12, to perform primary transfer for the toner image on the photosensitive body 3 to be transferred onto the intermediate belt 12; a belt cleaner 14 to remove residual toner on the intermediate transfer belt 12; and the secondary transfer roller 15, provided oppositely to the driving roller 10, to perform secondary transfer for a toner image formed on the intermediate transfer belt 12 to be transferred onto a recording medium (e.g., a sheet of paper).

The power supply 16 is provided below the exposing device 5, and the sheet feeding tray 17 is provided at the bottom of the body casing 2. A recording medium in the sheet feeding tray 17 is transported to the sheet discharge tray 21 by way of a pick-up roller 18, a transportation path 19, the secondary transfer roller 15, and the fixing unit 20. A holder 17*b* is attached to the sheet feeding tray 17 so as to be pulled out forward from the apparatus, and in order to handle a sheet of paper of a larger size, an auxiliary tray 17*a*, protruding from behind the apparatus, is attached so as to be pulled out from the apparatus.

With the image forming apparatus 1 configured as described above, when an image forming signal is inputted into the exposing device 5, the photosensitive body 3, a developing roller 6*a* provided with each toner cartridge in the rotary development unit 8, and the intermediate transfer belt 12 are driven under the control of the control unit, and the outer circumferential surface of the photosensitive body 3 is uniformly charged first by the charging device 4. Subsequently, the surface of the photosensitive body 3 is selectively exposed by the exposing device 5 according to image information to form an electrostatic latent image.

In this instance, the rotary development unit 8 is rotated such that the developing roller 6*a* of the toner cartridge is brought into contact with the photosensitive body 3. The electrostatic latent image is made visible as a toner image formed on the photosensitive body 3. The toner image is transferred onto the intermediate transfer belt 12 by the primary transfer roller 13 to which a primary transfer voltage of a polarity opposite to a toner charging polarity is being applied. Toner remaining on the photosensitive body 3 is then removed by the cleaner 7.

In a full-color image forming apparatus, toner cartridges 6Y, 6M, 6C, and 6K, respectively corresponding to yellow Y, magenta M, cyan C, and black K, are detachably mounted to the rotary development unit 8. During an image forming operation, the surface of the photosensitive body 3 is selectively exposed by the exposing device 5 according to image information of a first color, for example, yellow Y, to form an electrostatic latent image of yellow Y. In this instance, the rotary development unit 8 moves by rotation in such a manner that the developing roller 6*a* of the toner cartridge 6Y of yellow Y abuts on the photosensitive body 3 for a toner image of the electrostatic latent image of yellow Y to be formed thereon. The toner image is subsequently transferred onto the intermediate transfer belt 12 by the primary transfer roller 13 to which the primary transfer voltage of a polarity opposite to a toner charting polarity is being applied.

During the foregoing operations, the belt cleaner 14 and the secondary transfer roller 15 are kept spaced apart from the intermediate transfer belt 12. By repetitively performing a series of these operations for image forming signals of a second color, a third color, and a fourth color, toner images of yellow Y, magenta M, cyan C, and black K corresponding to the contents of the respective image forming signals are transferred from the photosensitive body 3 to be superposed sequentially on the intermediate transfer belt 12, and as a result, a full-color image of four colors is formed thereon.

At a timing at which a full-color image in which the respective colors of toner images are superposed reaches the secondary transfer roller 15, a recording medium in the feed tray 17 is transferred from the pickup roller 18 to the secondary transfer roller 15 via the transportation path 19, and the secondary transfer roller 15 is pressed against the intermediate transfer belt 12 while being applied with a secondary transfer voltage. The full-color toner image on the intermediate transfer bolt 12 is thereby transferred onto the recording medium by the secondary transfer roller 15. When the recording medium, onto which the full-color toner image has been transferred in this manner, is transferred to the fixing unit 20 via the street transfer unit 22, the toner image on the recording medium is heated and pressurized by the fixing unit 20 to be fixed thereon. Toner remaining on the intermediate transfer belt 12 is then removed by the belt cleaner 14.

In the case of double-sided printing, a recording medium coming out from the fixing unit 20 is switched back so that the rear end comes to the forefront, and is fed to the secondary transfer roller 15 again by way a double-sided printing transportation path in the sheet transportation unit 22. A full-color toner image on the intermediate transfer belt 12 is then transferred onto the other side of the recording medium, and is fixed thereon through heating and pressuring by the fixing unit 20 again, after which the recording medium is discharged onto the sheet discharge tray 21.

In this embodiment, four toner cartridges 6Y, 6M, 6C, and 6K are mounted to the rotary development unit 8 to constitute a full-color image forming apparatus of four colors. However, the toner cartridge 6K for the toner of black K alone may be mounted to constitute a monochrome image forming apparatus, in which the toner cartridge 6K stands by at the stand-by position (home position), and when an image is formed, the toner cartridge 6K of black K moves by rotation from the stand-by position to the developing position to develop an electrostatic latent image on the photosensitive body 3 into a toner image. This allows the use of the rotary development unit 8 of the same design specifications for both full-color and monochrome images. By using the common specifications for full-color and monochrome images, it is possible to remarkably save the maintenance, design, and manufacturing costs in comparison with a case where an image forming apparatus is designed separately for a full-color image and a monochrome image.

The mechanism of irregularities in the rotation velocity of the photosensitive body and a countermeasure will now be described with reference to FIGS. 2 and 3.

In the color image forming apparatus of this embodiment, while the rotary development unit 8 is in a stand-by state and stays at the home position, none of the toner cartridges 6Y, 6M, 6C, and 6K is present at the developing position to oppose the photosensitive body 3. In short, the developing roller 6*a* does not abut on the photosensitive body 3. Normally, even when no image is written by the exposing device 5, a slight quantity of fogging toner mounts on the photosensitive body 3 while the developing roller 6*a* abuts on the photosensitive body 3, and the fogging toner serves as a kind or lubricant at the abutting point of the cleaner 7. This enables smooth frictional sliding of the photosensitive body 3 with respect to the cleaner 7, and as a consequence, there is only a slight irregularity in the rotation velocity of the photosensitive body 3.

However, when the surface of the photosensitive body 3 cleaned by the cleaner 7 moves by rotation and abuts on the cleaner 7 again to undergo frictional sliding while the developing roller 6*a* is kept spaced apart from the photosensitive body 3, because no fogging toner is present, the frictional resistance of the photosensitive body 3 becomes larger on the abutting point of the cleaner 7, which in turn makes the rotational velocity of the photosensitive body 3 unstable. In other words, as the frictional resistance on the surface of the photosensitive body 3 becomes larger, the photosensitive body 3 is thought to repetitively undergo minute locking and releasing phenomena with respect to the cleaner 7, which appears as irregularities in the velocity and vibrations of the photosensitive body 3.

Figure 2:
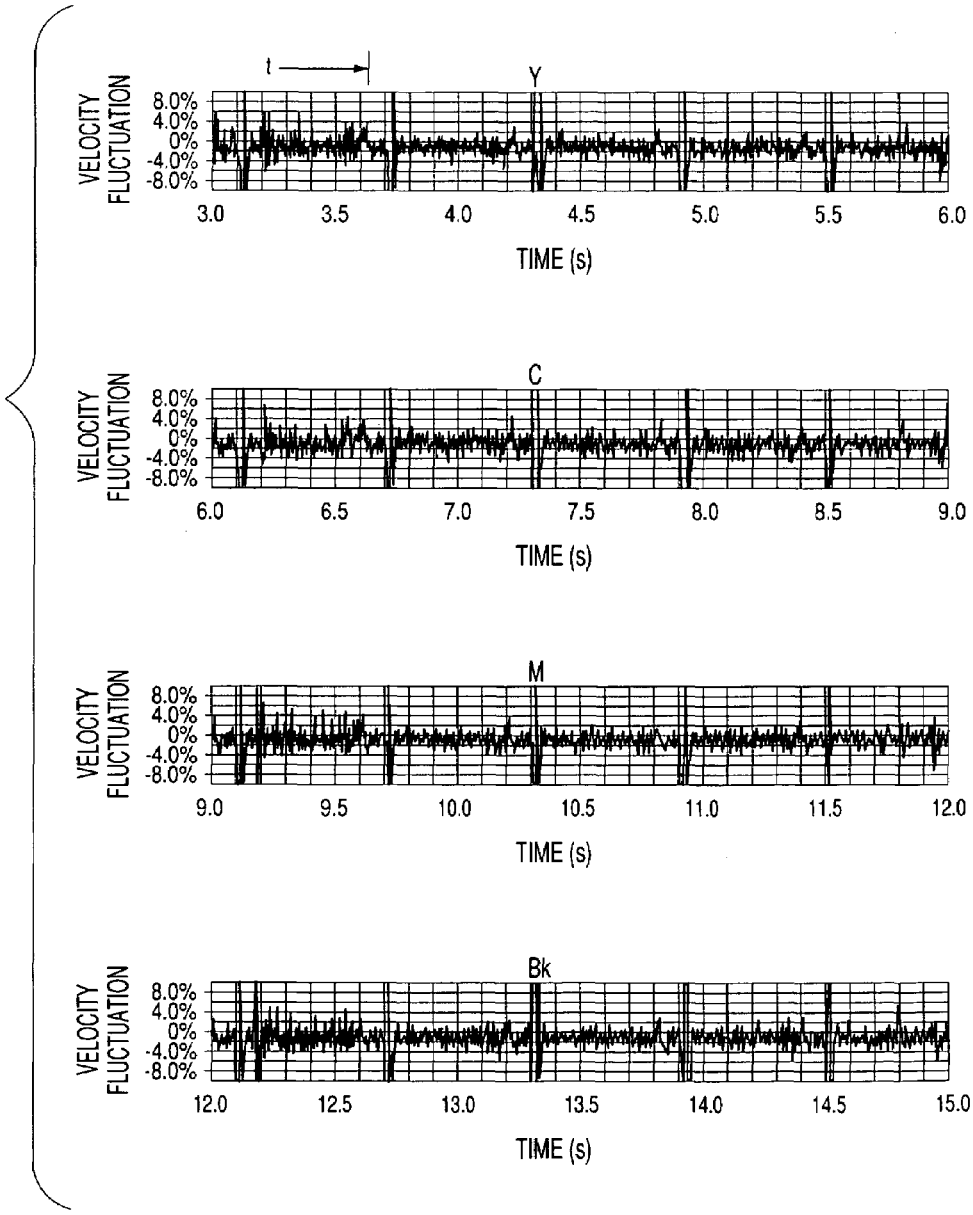
FIG. 2 is measurement data showing irregularities in the rotation velocity of a photosensitive body.

Referring to FIG. 2, the ordinate is used for velocity fluctuations and the abscissa is used for the time. It should be noted that considerable velocity fluctuations appear periodically due to a disturbance of signals at the connection of the encoder that detects rotations, and because they do not indicate direct irregularities of rotations, they are negligible. The measurement data is obtained through the development color switching operation, by which the toner cartridge 6 is switched to allow the developing roller 6*a* to abut on the photosensitive body 3 at the timing at which exposure is performed according to an image signal for the respective colors Y, M, C, and K, and from the measurement data, one can observe a time period "t" having considerable velocity fluctuations immediately after the start of exposure. The velocity fluctuations continue during a time duration since the developing roller 6*a* has abutted on the photosensitive body 3 until the abutting point reaches the cleaner 7, and then disappear.

An area where irregularities in the rotation velocity of the photosensitive body are generated due to the operation sequence will now be described. FIG. 3 schematically shows the operation sequence of the color image forming apparatus 1 of this embodiment. In this figure, there are shown the on/off states of a vertical synchronous (vsync) signal, a motor for driving the intermediate transfer belt 12, a motor for driving the exposing device 5, the image forming signal, the primary transfer bias and the secondary transfer bias. There is also shown a state of the developing roller 6*a*, that is, the developing roller is subjected to the development color switching or the developing operation.

The oblique line "m" indicates the movement of a position on the photosensitive body 3 at which the developing roller 6*a* comes in contact. That is, an intersection between the oblique line "m" and the horizontal line labeled as "cleaning blade" means that the position at which the development roller 6*a* comes in contact reaches the abutment point of the cleaner 7.

Similarly, the oblique line "n" indicates the movement of a position on the photosensitive body 3 at which the developing roller 6*a* separates to be subjected to the development color switching. That is, an intersection between the oblique line "n" and the horizontal line labeled as "cleaning blade" means that the position at which the development roller 6*a* separates reaches the abutment point of the cleaner 7.

Figure 3:
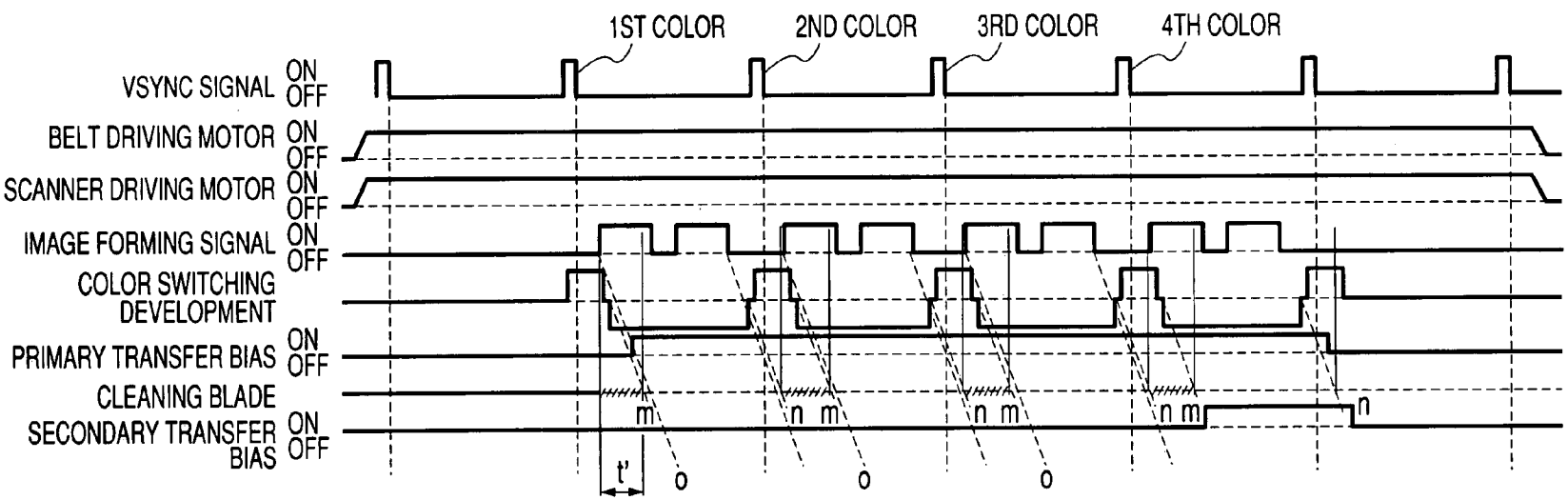
FIG. 3 is a diagram for explaining generation of the rotation velocity irregularities.

As is shown in FIG. 3, the intermediate transfer belt 12 and the exposing device 5 starts driving first. Then the development color switching of the rotary development unit 8 is performed. At a timing derived from the vsync signal, the exposing device 5 forms a latent image based on the image forming signal and the latent image is made visible as a toner image by the developing roller 6*a*.

As is shown in FIG. 1, the exposing point on the photosensitive body 3 is on the upstream side of rotations from the developing position, the developing roller 6*a* may be abutted on the photosensitive body 3 after the image forming signal is activated (the exposure is performed) but before the exposing point reaches the developing position (the intersection between the oblique line "o" and the horizontal line labeled "color switching and development").

After that, the primary transfer bias is applied when the toner image reaches the primary transfer position (the intersection between the oblique line "o" and the horizontal line labeled "primary transfer bias") to primarily transfer the toner image onto the intermediate transfer belt 12.

Hence, for a time period t' from the point in time at which the image forming signal is activated to the point in time at which the development roller 6*a* comes in contact reaches the abutment point of the cleaner 7, an area of the photosensitive body 3 in which the developing roller 6*a* has not been abutted (that is, toner as the lubricant is absent) is subjected to the frictional contact with the cleaner 7. The time period t' is therefore an area where irregularities in the rotation velocity of the photosensitive body 3 are generated. For the second through fourth colors, this area is similarly defined as a time period between the intersections of the oblique lines m and n with respect to the horizontal line labeled as "cleaning blade".

In view of the above, in this embodiment, lubricant such as toner is supplied to the photosensitive body 3 where the developing roller 6*a* is not abutted thereon during the development color switching. Specifically, the lubricant is supplied so as to be present at a portion of the photosensitive body 3 that comes in contact with the cleaner 7 when the exposure with a beam B (see FIG. 1) is started (when the image forming signal is activated). The supply of the lubricant is continued from the portion for a predetermine area on the photosensitive body 3. This is because the affection of the irregularities of the photosensitive body 3 with respect to the image formation is negligible before the exposure is started (before the image forming signal is activated). In other words, there may be configured the exposure is inhibited when the lubricant is not present at the portion of the photosensitive body 3 that comes in contact with the cleaner 7.

Specifically, the supply of lubricant is performed by forming a dummy toner image on an area of the intermediate transfer belt 12 opposing the photosensitive body 3 that passes by the developing position during the development color switching. The dummy image on the intermediate transfer belt 12 is thus transferred reversely onto the photosensitive body 3 at the primary transfer point, by controlling the primary transfer bias, the contact velocity or pressure between the intermediate transfer belt 12 and the photosensitive body 3, or without having to perform any special control. The toner reversely transferred onto the photosensitive body 3 serves as the lubricant between the photosensitive body 3 and the cleaner 7, which makes it possible to stably maintain the rotation velocity of the photosensitive body 3.

The above fact can be expressed as explained below. In this embodiment, the exposure with the beam B from the exposing device 5 performed after the development color switching of the rotary development unit 8 is so controlled as to start after the portion of the photosensitive body 3 onto which the lubricant such as toner has been supplied reaches the abutment point of the cleaner 7. For example, the initiation of exposure is suspended until the toner image which has been reversely transferred from the intermediate transfer belt 12 onto the photosensitive body 3 reaches the abutment point of the cleaner 7. Here, there may be performed judgment whether the lubricant is supplied on the photosensitive body 3 at the abutment point of the cleaner 7. The exposure may be canceled if the absent of the lubricant at the abutment point of the cleaner 7 is judged.

In order to transfer the toner image reversely from the intermediate transfer belt 12 onto the photosensitive body 3, it is necessary to keep the belt cleaner 14 spaced apart so that the toner present on the intermediate transfer belt 12 will not be removed until it is transported to the primary transfer point.

The toner image on the intermediate transfer belt 12 may be the above described dummy image or the fogging toner transferred from the photosensitive body 3 at the primary transfer point.

Figure 4:
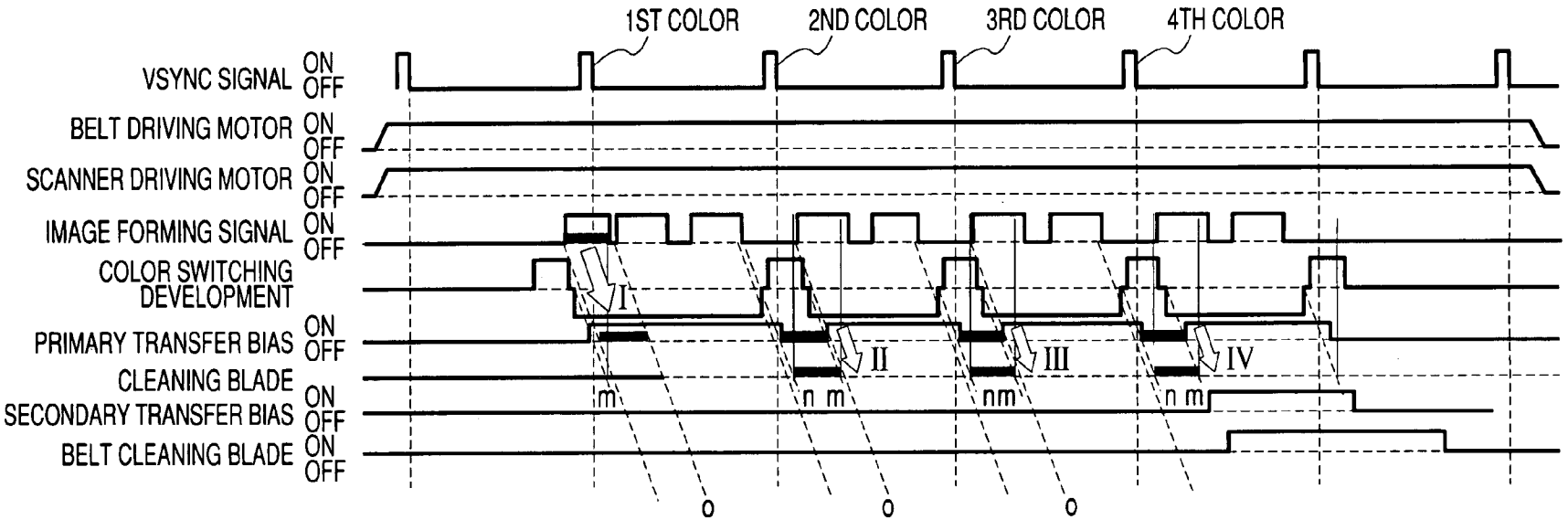
FIG. 4 is a diagram for explaining a dummy image formation performed in the image forming apparatus of FIG. 1.

The formation of the dummy toner image will be described with reference to FIG. 4 which is analogous to FIG. 3.

In this case, the dummy image (black-painted part) is first formed and transferred onto the intermediate transfer belt 12 (indicated by an arrow I) before an image formation for the first color is performed. Since the residual toner is present on the photosensitive body 3 even after the primary transfer is performed, the photosensitive body 3 and the cleaner 7 undergo frictional sliding smoothly, thereby eliminating velocity fluctuations of the photosensitive body 3.

For the image formation of the second, the third and the fourth colors, the primary transfer bias is controlled such that the dummy toner image is reversely transferred from the intermediate transfer belt 12 onto an area of the photosensitive body where the developing rollers 6*a* have not been abutted during the development color switching (indicated by arrows II, III and IV). It is thus possible to eliminate a time duration during which the lubricant is absent on the abutting portion between the photosensitive body 3 and the cleaner 7 at least while a latent image is formed by an exposing beam B.

While the developing roller 6*a* is abutted on the photosensitive body 3, fogging toner may be supplied even if any toner image is formed thereon, so that the fogging toner serves as the lubricant. When the toner image formed and transferred onto the intermediate transfer belt 12, the toner residual on the photosensitive body 3 may serve as the lubricant.

In view of the above, a slight quantity is sufficient for the toner to be transferred reversely as the lubricant from the intermediate transfer belt 12 onto the photosensitive body 3. It is thus possible to transfer the dummy toner image reversely from the intermediate transfer belt 12 little by little repetitively more than once, by controlling a quantity of toner to be transferred reversely at the primary transfer point. The number of repetition times can be controlled by the number of image formations or a quantity of toner used for the dummy image, or the bias used for inverse transfer.

The dummy image to be transferred in advance from the photosensitive body 3 onto the intermediate transfer belt 12 can be a periodical line image formed, for example, by exposing an exposing beam B from the exposing device 5 in a cycle of 1-line ON and 10-line OFF, or an image of a regular dot pattern. An image area and a non-image area are assigned on the intermediate transfer belt 12. When the exposing device 5 starts exposure from a given point (i.e., the image area) with the use of an exposing beam B according to an image signal, the point at which the photosensitive body 3 abuts on the cleaner 7 is found, and the area, across which the toner is to be transferred in advance (i.e., the non-image area), is determined on the basis of the computation.

Figure 5:
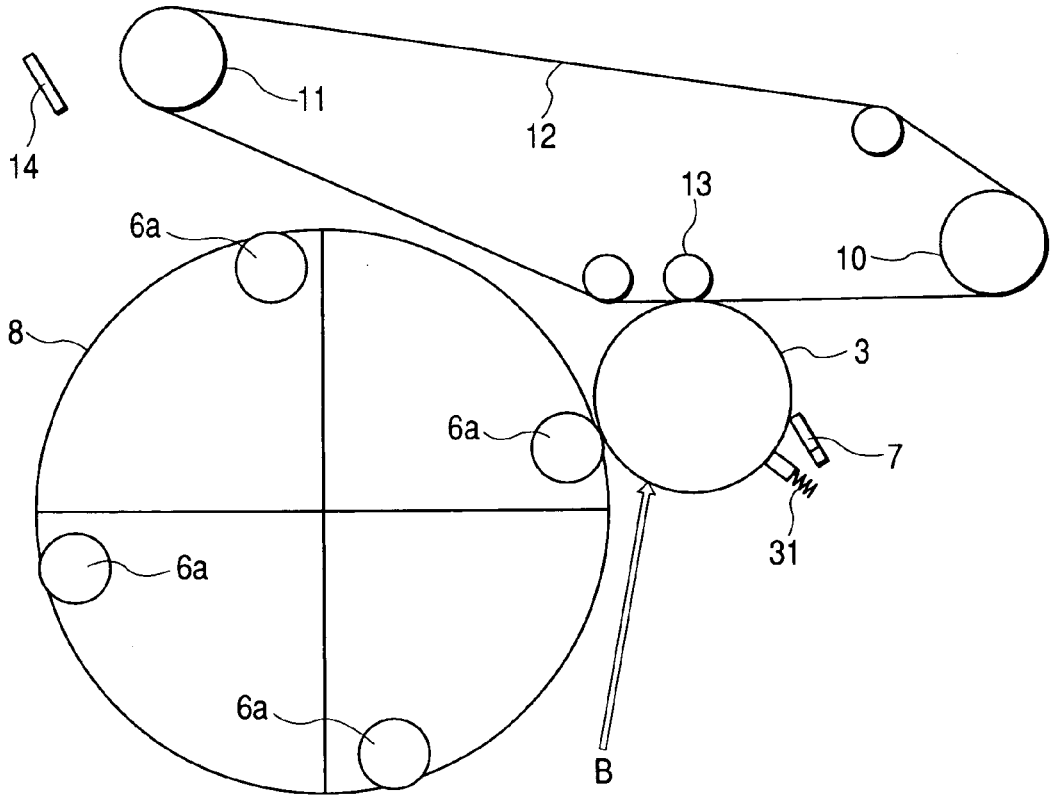
FIG. 5 is a schematic side view showing a first modified example of the image forming apparatus of FIG. 1.

Instead of the dummy image formation, as shown in FIG. 5, a lubricant supplier 31 may be provided to directly supply lubricants including zinc stearate and lubricant toner onto the desired portion of the photosensitive body 3, besides waste toner removed from the photosensitive body 3 through cleaning, so that the lubricant is prevented from running out on the peripheral surface of the photosensitive body 3.

Figure 6:
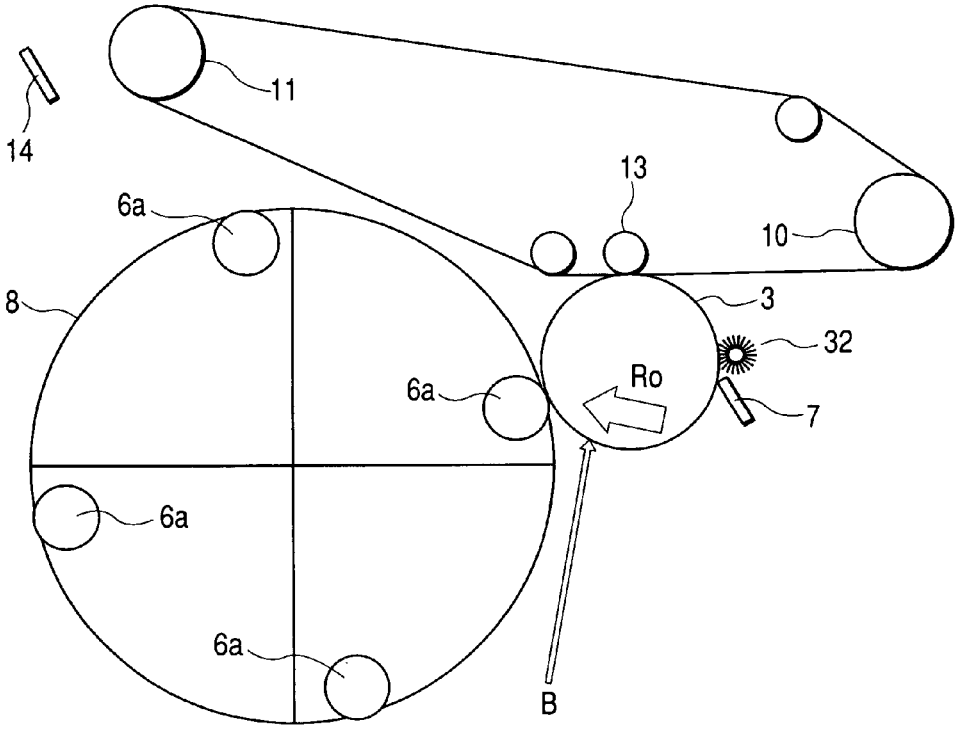
FIG. 6 is a schematic side view showing a second modified example of the image forming apparatus of FIG. 1.

Alternatively, as is shown in FIG. 6, a waste toner circulation mechanism 32 (e.g., a rotary brush, a brush and a roller) may be provided in the vicinity of the cleaner 7, so that waste toner removed from the photosensitive body 3 by the cleaner 7 is circulated and returned to the peripheral surface of the photosensitive body 3.

Figure 7A:
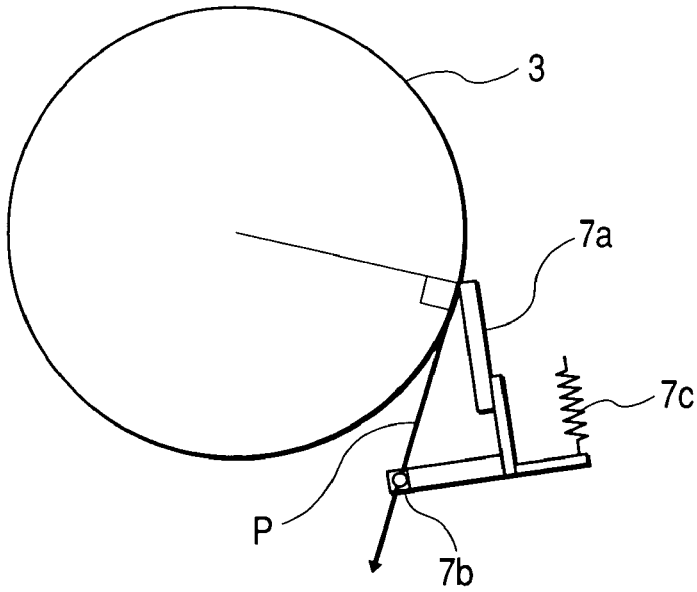
FIGS. 7A and 7B are schematic side views showing examples of a cleaner for a photosensitive body in the image forming apparatus or FIG. 1.
Figure 7B:
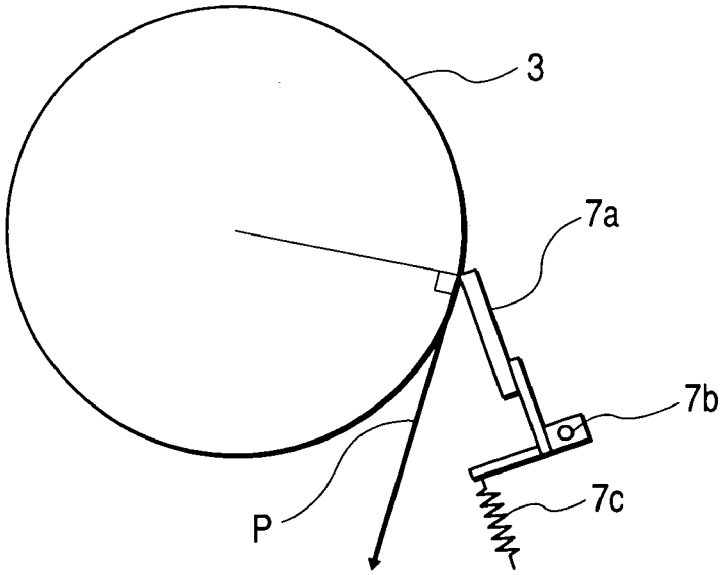

As shown in FIG. 7A, the cleaner 7 is specifically configured such that a blade 7*a* is pressed against the photosensitive body 3 at a predetermined pressure about a supporting point 7*b* by a spring 7*c*. The position of the supporting point 7*b* is provided on the tangential line p along which the blade 7*a* abuts on the photosensitive body 3, or on the outside of the tangential line p (further from the photosensitive body 3) as shown in FIG. 7B. With the use of the supporting point 7*b* positioned as described above, the abutting state of the cleaner 7 with respect to the photosensitive body 3 can be maintained in a more stable manner against a disturbance in rotations of the photosensitive body 3 than in a case where the supporting point 7*b* of the cleaner 7 is provided on the inside of the tangential line p abutting on the photosensitive body 3 (closer to the photosensitive body 3).

The control for replenishing toner on the photosensitive body 3 from the intermediate transfer belt 12 will now be described in more detail with reference to FIGS. 8 through 15.

Figure 8:
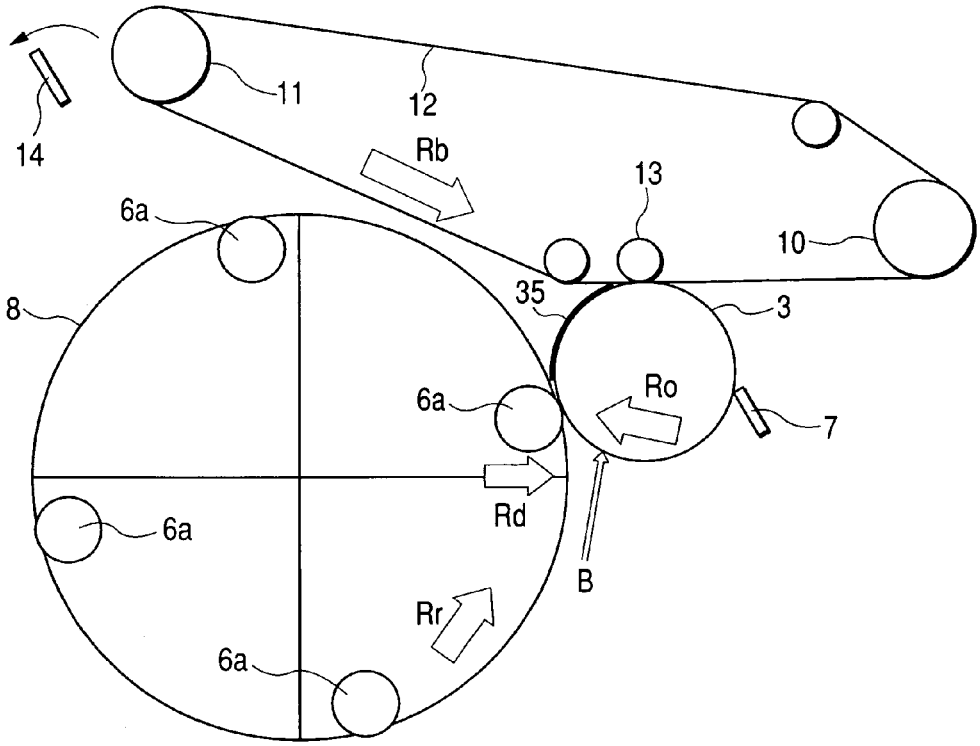
FIG. 8 is a schematic side view showing a state that the dummy image formation is performed.

In this embodiment, prior to the image forming operation, the photosensitive body 3, the developing roller 6*a* of the rotary development unit 8, and the intermediate transfer belt 12 are driven to rotate in the directions Ro, Rd, and Rb, respectively, and the outer circumferential surface of the photosensitive body 3 is thereby charged uniformly by the charging device 4. Subsequently, as shown in FIG. 8, the dummy image is exposed on the surface of the photosensitive body 3 by the exposing device 5 to form an electrostatic latent image. In this instance, the rotary development unit 8 moves by rotation in the direction Rr such that the developing roller 6*a* of the toner cartridge 6 abuts on the photosensitive body 3. A dummy toner image 35 is thus formed on the photosensitive body 3.

Figure 9:
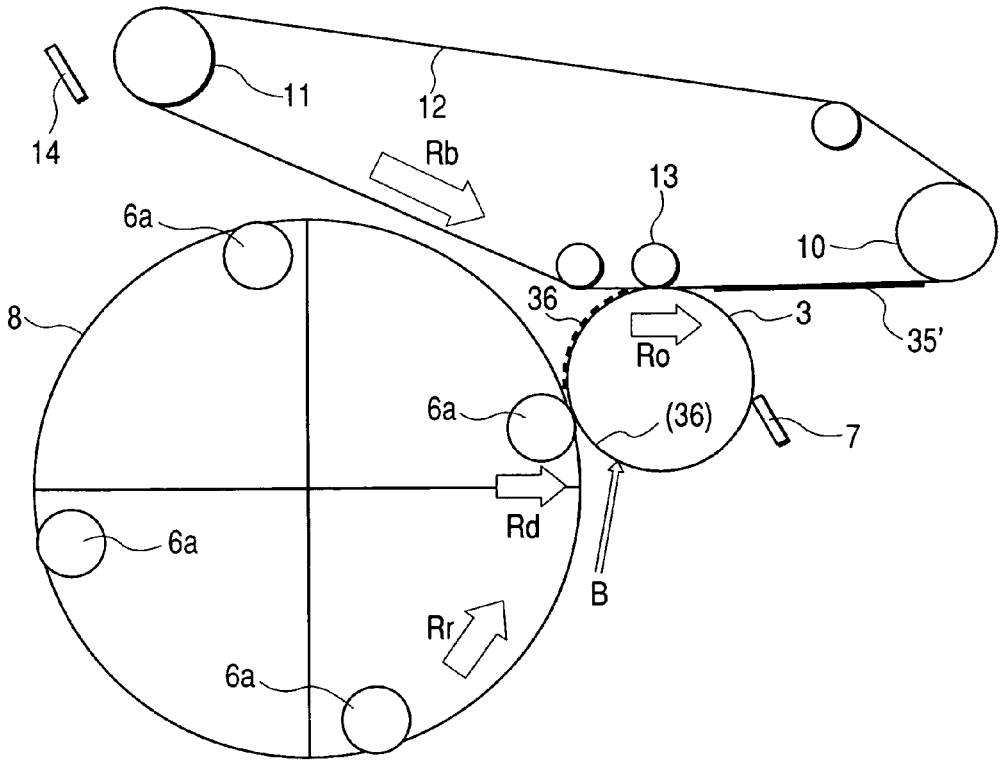
FIG. 9 is a schematic side view showing a state that a toner image of the first color is developed.

As is shown in FIG. 9, the dummy toner image 35 formed on the photosensitive body 3 is transferred onto the intermediate transfer belt 12 from the photosensitive body 3 as a toner image 35' by the primary transfer roller 13 to which the primary transfer voltage of a polarity opposite to the toner charging polarity is being applied. The exposure and the development for a toner image 36 to be subjected to the primary transfer is then performed.

Figure 10:
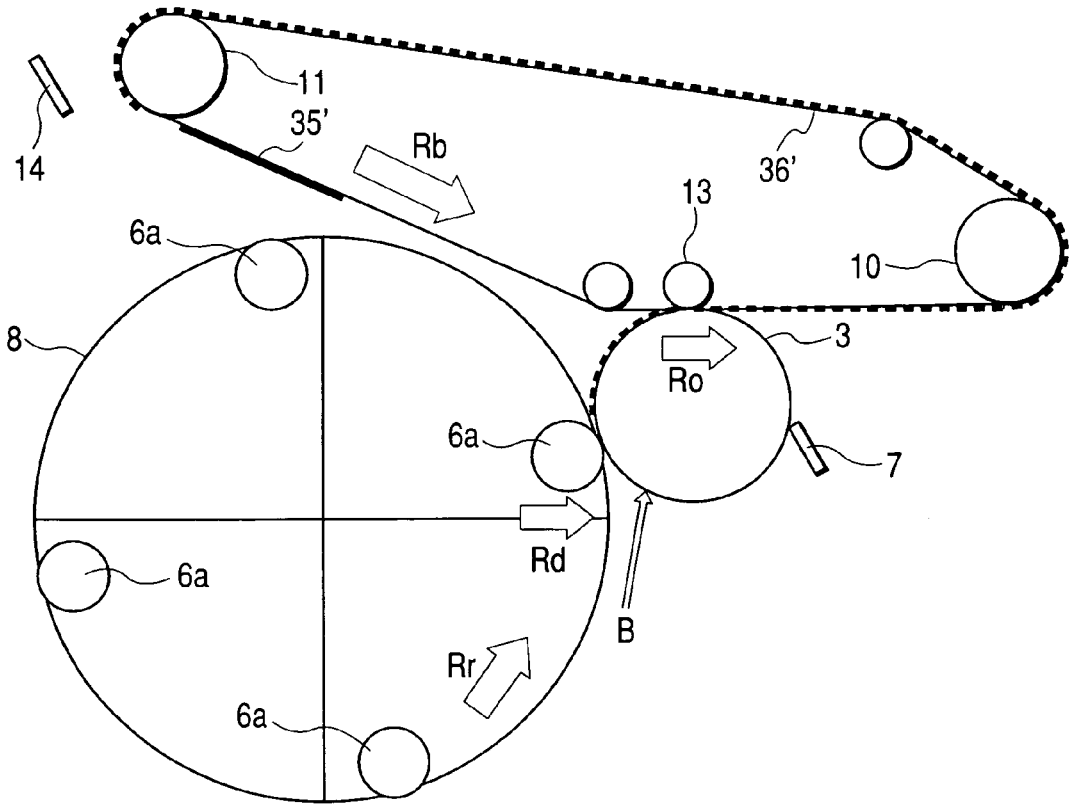
FIG. 10 is a schematic side view showing a state that the toner image of the first color is primarily transferred onto an intermediate transfer belt.
Figure 11:
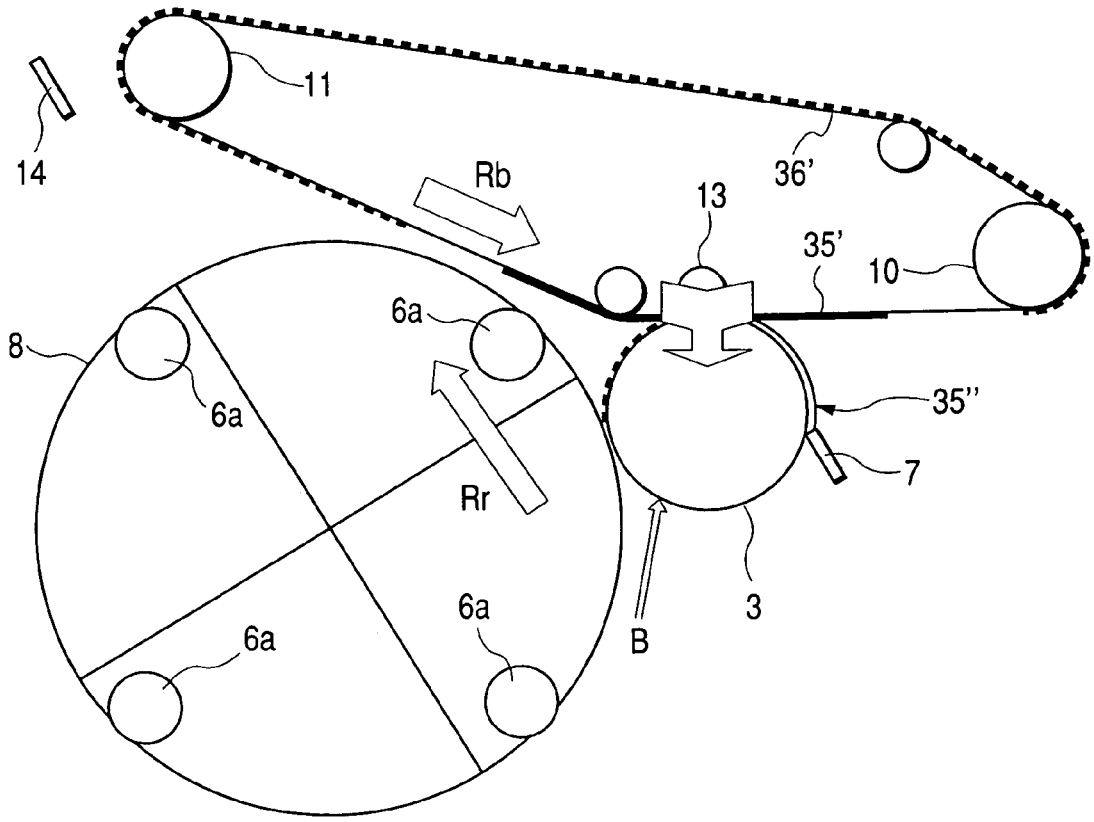
FIG. 11 is a schematic side view showing a state that the dummy image is reversely transferred onto the photosensitive body during the development color switching.

Since the belt cleaner 14 and the secondary transfer roller 15 are kept spaced apart from the intermediate transfer belt 12, when the toner image 36 of the first color has been formed on the photosensitive body 3, the dummy toner image 35' on the intermediate transfer belt 12 approaches the primary transfer point as shown in FIG. 10, In order to perform the image formation of the second color, the development color switching of the rotary development unit 8 is performed. Then, as shown in FIG. 11, the development rotary unit 8 moves by rotation in the direction Rr, so that the developing roller 6*a* is spaced apart from the photosensitive body 3. The dummy toner image 35', which has been transferred onto the intermediate transfer belt 12 in advance, reaches the primary transfer point and is then transferred reversely onto the photosensitive body 3 as a toner image 35". Due to this reverse transfer, toner is replenished on the photosensitive body 3 at the primary transfer point even when the developing roller 6*a* is kept spaced apart from the photosensitive body 3, and is thereby supplied to the abutting portion to the cleaner 7 as the lubricant.

Figure 12:
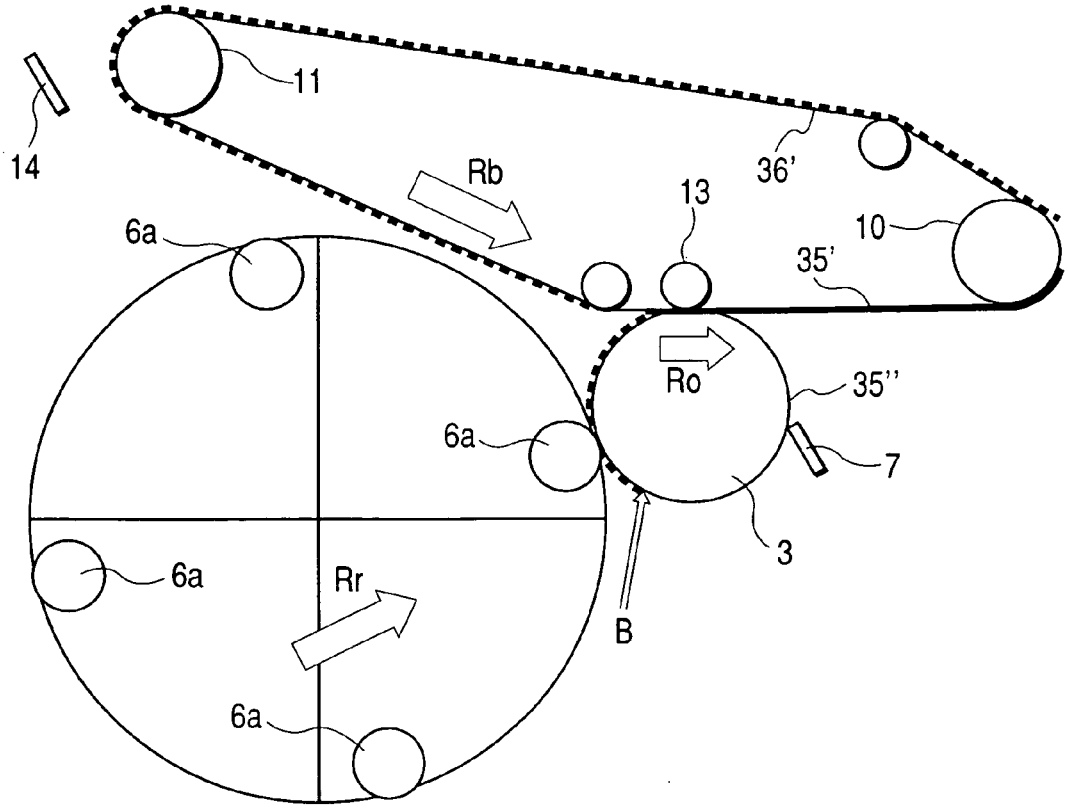
FIG. 12 is a schematic side view showing a state that a toner image of the second color is developed.

Likewise, when the image formation of the second color is started, as shown in FIG. 12, at a time point where the exposing device 5 exposes the photosensitive body 3 by an exposing beam B, the toner image 35", which has been reversely transferred from the intermediate transfer belt 12 and replenished on the photosensitive body 3 as the lubricant, is supplied to the abutting portion of the cleaner 7. It is thus possible to maintain stable rotations of the photosensitive body 3. Thereafter, the image forming operation of the third color is performed in the same manner.

Figure 13:
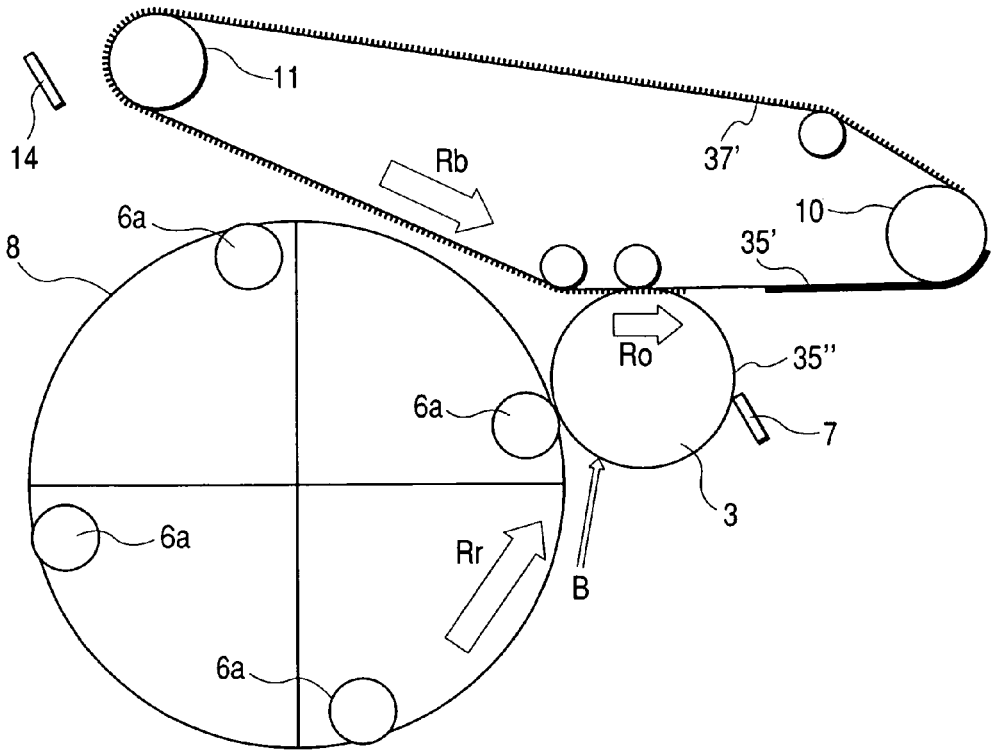
FIG. 13 is a schematic side view showing a state that a toner image of the final color is developed.
Figure 14:
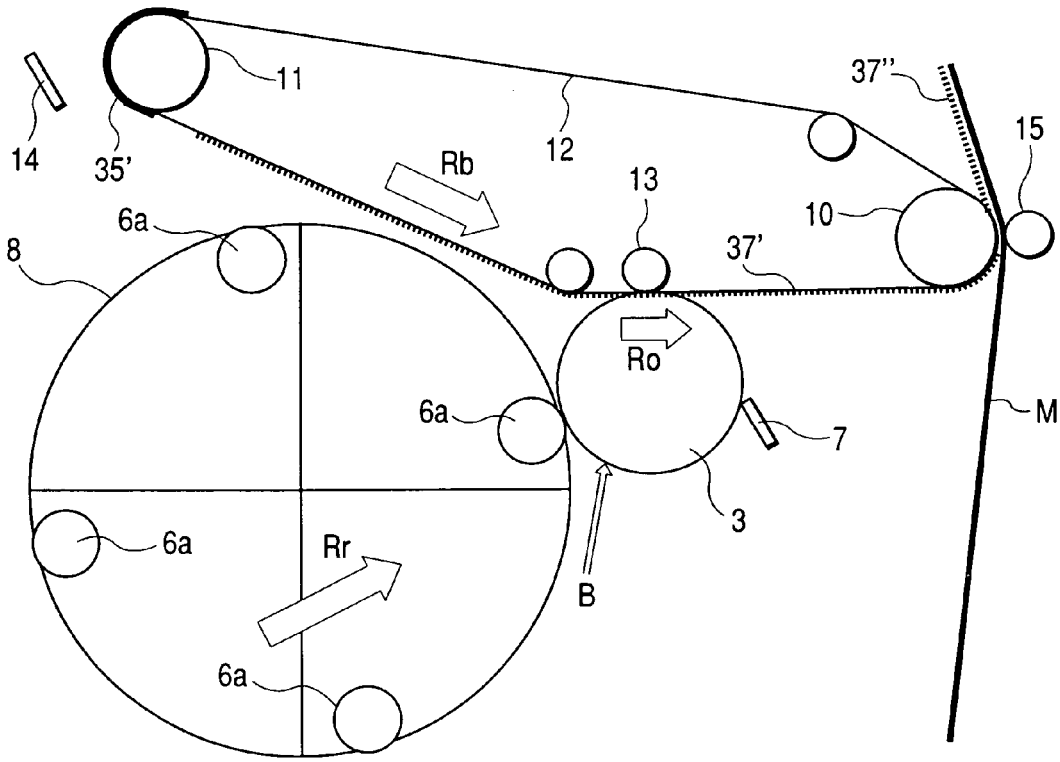
FIG. 14 is a schematic side view showing a state that a full color toner image is secondary transferred onto a recording medium.

When the image formation of the fourth color is started, as shown in FIG. 13, images of all the colors are superposed on the intermediate transfer belt 12, and as shown in FIG. 14, the secondary transfer roller 15 abuts on the intermediate transfer belt 12 to secondarily transfer a full-color toner image 37' from the intermediate transfer belt 12 onto a recording medium M to form a transferred image 37" thereon.

Figure 15:
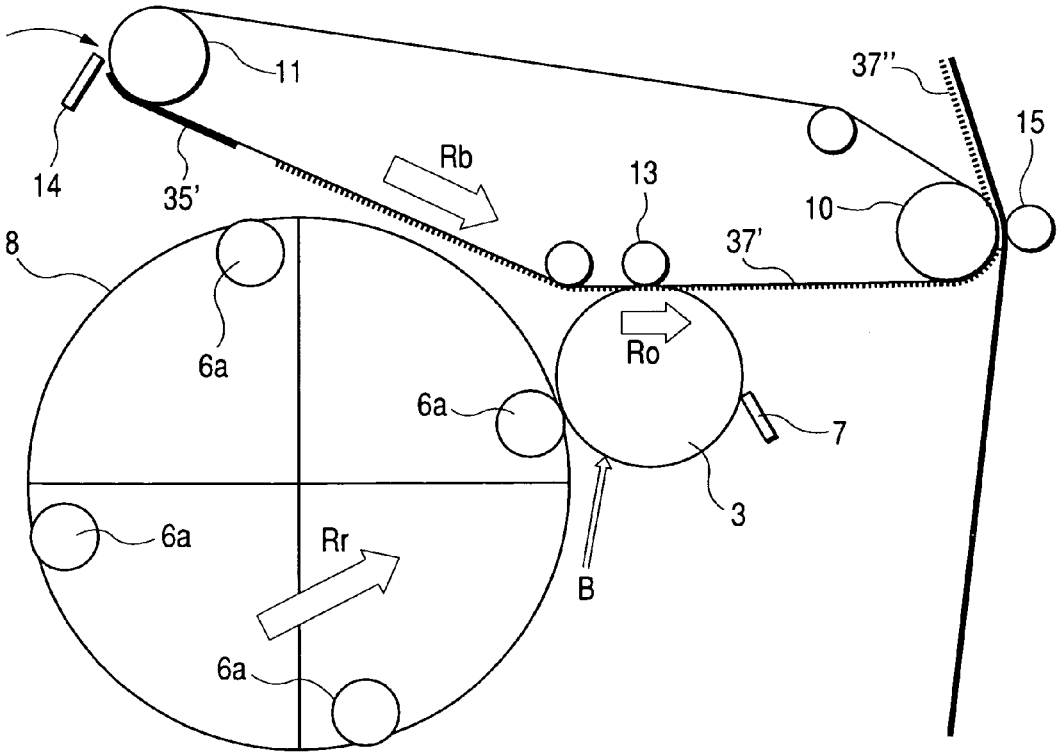

During the foregoing operations, the belt cleaner 14 is kept spaced apart from the intermediate transfer belt 12 as are shown in FIGS. 8 through 14. However, as shown in FIG. 15, when the dummy toner image 35' on the intermediate transfer belt 12 passes by, the belt cleaner 14 abuts on the intermediate transfer belt 12 and starts to clean the toner remained thereon in an area corresponding to a print image area. The residual toner after the secondary transfer of the print image on the intermediate transfer belt 12 is thus removed.

Figure 16:
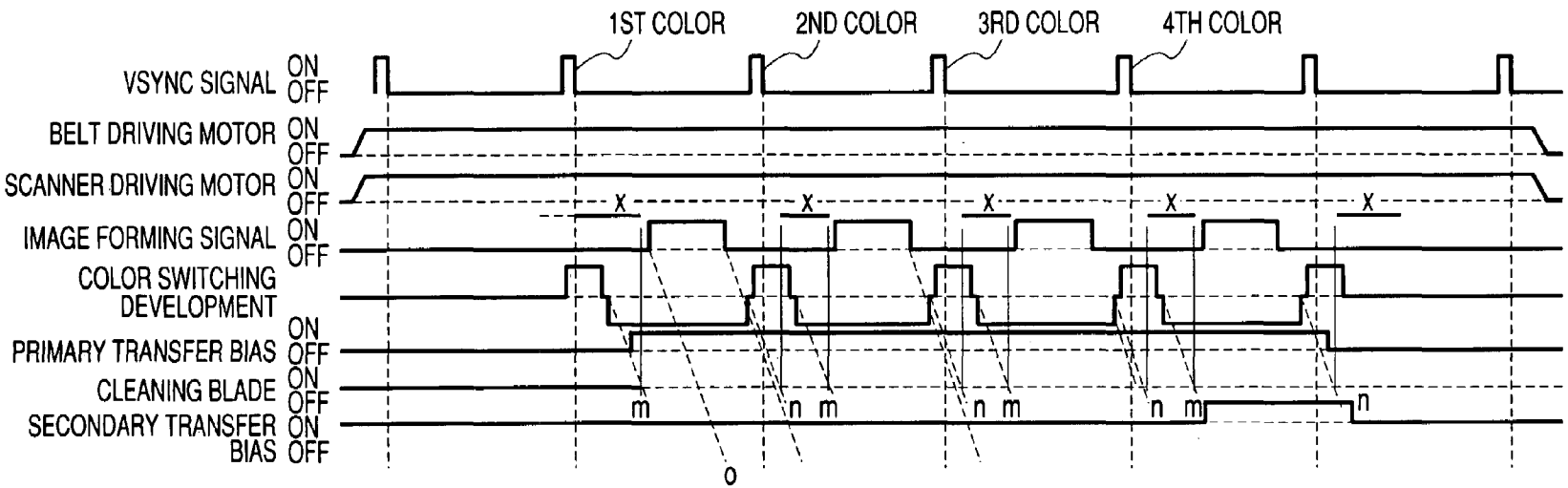
FIG. 16 is a schematic side view showing a state that a cleaning operation is performed with respect to the intermediate transfer belt.

As has been described, by positively replenishing toner on the photosensitive body 3 in an area where the lubricant runs out during the developing color switching during which the developing roller 6*a* is kept spaced apart from the photosensitive body 3, the subsequent exposure can be started as soon as the developing color switching is completed, which can shorten a so-called sheet-to-sheet interval. In a case where no toner is present on the photosensitive body 3 that opposes the cleaner 7 during the operation sequence involving the development color switching, the exposure may not be performed as is shown in FIG. 16. A time period X during which the photosensitive body 3 opposes the blade of the cleaner 7 since the development color switching is started after the completion of the developing operation for one color until the developing operation for the next color is started, that is, a time period during which no toner is supplied on the photosensitive body 3 that opposes the blade of the cleaner 7. Therefore, an image forming signal is activated to start the exposure after the period X, that is, after the photosensitive body 3 supplied with toner reaches the position to oppose the blade of the cleaner 7. Even in a case where the latent image formation is performed after the condition such that eliminates vibrations of the photosensitive body 3 is satisfied without forming the dummy toner image as described above, it is effective when an interval between the developing position and the position of the cleaner 7 is shortened, which can in turn extend the peripheral length of the intermediate transfer belt 12 in securing a sufficient sheet-to-sheet interval.

It should be appreciated that the invention is not limited to the embodiments above, and can be modified in various manners. For example, an applicable apparatus is not necessarily limited to a rotary-type full-color image forming apparatus equipped with the rotary development unit, provided that the apparatus is of a type in which the developing roller is kept spaced apart from the photosensitive body during the standby state and the developing roller is abutted on the photosensitive body according to a job execution in performing the image formation. Also, it goes without saying that the invention is applicable to a monochrome image forming apparatus regardless of whether the apparatus is equipped with the rotary development unit or not in solving the similar problems.

Further, when the dummy image is transferred reversely onto the photosensitive body from the intermediate transfer belt, not only the bias in the opposite direction is applied, but also the primary transfer bias may be controlled by lowering the primary transfer bias to reduce a potential difference or deactivating the primary transfer bias. Alternatively, the circumferential velocity or the contact pressure of the primary transfer roller may be changed.

In addition, the dummy image is not necessarily formed in the form of a toner image of the first color or black K, and it may be formed, for example, in the form of n toner image of yellow Y having a low visibility. The dummy image is not necessarily formed immediately before the image formation of the first color, and it may be formed during the position setting operation by which the cartridge or the unit is set in the standby state for replacement, or when the image forming operation is started from the standby state, and thereafter, it may be formed on the intermediate transfer belt based on certain criteria according to the number of jobs having been performed.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An image forming apparatus, comprising:

an image carrier, on which an electrostatic latent image is formed;

a developing roller, separatably abutted on the image carrier at a developing position to supply toner onto the image carrier to make the latent image visible as a toner image;

a transfer member, on which the toner image is transferred;

a cleaner, abutted on the image carrier to remove toner remained thereon; and a toner supplier, which supplies toner onto the image carrier while the developing roller is separated from the image carrier.

2. The image forming apparatus as set forth in claim 1, wherein the toner supplier is a circulator which returns the toner removed by the cleaner onto the image carrier.

3. The image forming apparatus as set forth in claim 2, wherein the circulator is a rotary brush.

4. The image forming apparatus as set forth in claim 1, wherein the toner supplier reversely transfers toner, which has been once transferred from the image carrier to the transfer member, from the transfer member to the image carrier.

5. The image forming apparatus as set forth in claim 4, wherein the toner is reversely transferred onto a portion of the image carrier that passes the developing position while the developing roller is separated from the image carrier.

6. The image forming apparatus as set forth in claim 1, wherein the developing roller is mounted on a rotary unit operable to move the developing roller in a circumferential direction thereof, thereby separating the developing roller from the image carrier.

7. The image forming apparatus as set forth in claim 6, wherein the rotary unit comprises a plurality of cartridges each of which contains one color of toner different from another and is provided with the developing roller.

8. The image forming apparatus as set forth in claim 1, wherein the cleaner comprises a blade member which is pivotable about a point situated further from the image carrier relative to a tangential line defined at an abutting point between the blade member and to the image carrier.

9. An image forming apparatus comprising:

an image carrier, on which an electrostatic latent image is formed;

a developing roller, separatably abutted on the image carrier at a developing position to supply toner onto the image carrier to make the latent image visible as a toner image;

a transfer member, on which the toner image is transferred;

a cleaner, abutted on the image carrier to remove toner remained thereon; and a lubricant supplier, which supplies lubricant onto the image carrier while the developing roller is separated from the image carrier.

10. The image forming apparatus as set forth in claim 9, wherein the lubricant supplier is a circulator which returns the toner removed by the cleaner onto the image carrier as the lubricant.

11. The image forming apparatus as set forth in claim 10, wherein the circulator is a rotary brush.

12. The image forming apparatus as set forth in claim 9, wherein the lubricant supplier is a coater which directly coats the lubricant onto the image carrier.

13. The image forming apparatus as set forth in claim 12, wherein the lubricant includes zinc stearate.

14. The image forming apparatus as set forth in claim 9, wherein the lubricant supplier reversely transfers toner, which has been once transferred from the image carrier to the transfer member, from the transfer member to the image carrier as the lubricant.

15. The image forming apparatus as set forth in claim 14, wherein the toner is reversely transferred onto a portion of the image carrier that passes the developing position while the developing roller is separated from the image carrier.

16. The image forming apparatus as set forth in claim 9, wherein the developing roller is mounted on a rotary unit operable to move the developing roller in a circumferential direction thereof, thereby separating the developing roller from the image carrier.

17. The image forming apparatus as set forth in claim 16, wherein the rotary unit comprises a plurality of cartridges each of which contains one color of toner different from another and is provided with the developing roller.

18. The image forming apparatus as set forth in claim 9, wherein the cleaner comprises a blade member which is pivotable about a point situated further from the image carrier relative to a tangential line defined at an abutting point between the blade member and to the image carrier.

19. An image forming apparatus, comprising:

an image carrier, on which an electrostatic latent image is formed, a developing roller, separatably abutted on the image carrier at a developing position to supply toner onto the image carrier to make the latent image visible as a toner image;

a first transfer member, on which the toner image is primarily transferred; and a first cleaner, abutted on the image carrier to remove toner remained thereon, wherein a dummy toner image is formed on a portion of the first transfer member which faces a portion of the image carrier that passes the developing position while the developing roller is separated from the image carrier.

20. The image forming apparatus as set forth in claim 19, wherein the dummy toner image is periodically formed.

21. The image forming apparatus as set forth in claim 19, wherein the dummy toner image is formed every time when the toner image is formed in a predetermined number of times.

22. The image forming apparatus as set forth in claim 19, wherein the dummy toner image is an image in which a plurality of lines are arrayed with a fixed interval.

23. The image forming apparatus as set forth in claim 19, wherein the dummy toner image is an image in which a plurality of dots are arrayed with a fixed interval.

24. The image forming apparatus as set forth in claim 19, wherein the dummy toner image is reversely transferred onto the portion of the image carrier that passes the developing position while the developing roller is separated from the image carrier.

25. The image forming apparatus as set forth in claim 19, further comprising:

a second transfer member, which secondarily transfer the toner image from the first transfer member onto a recording medium; and a second cleaner, operable to remove toner remained on the first transfer member, the second cleaner being separated from the first transfer member so as to avoid the dummy toner image.

26. The image forming apparatus as set forth in claim 19, wherein the developing roller is mounted on a rotary unit operable to move the developing roller in a circumferential direction thereof, thereby separating the developing roller from the image carrier.

27. The image forming apparatus as set forth in claim 26, wherein the rotary unit comprises a plurality of cartridges each of which contains one color of toner different from another and is provided with the developing roller.

28. The image forming apparatus as set forth in claim 19, wherein the first cleaner comprises a blade member which is pivotable about a point situated further from the image carrier relative to a tangential line defined at an abutting point between the blade member and to the image carrier.

29. An image forming apparatus, comprising:

an image carrier;

a latent image former, which forms an electrostatic latent image on the image carrier, a developing roller, separatably abutted on the image carrier at a developing position to supply toner onto the image carrier to make the latent image visible as a toner image;

a first transfer member, on which the toner image is primarily transferred;

a first cleaner, abutted on the image carrier to remove toner remained thereon; and a toner supplier, which supplies toner onto the image carrier such that the supplied toner is placed on a portion of the image carrier at which the first cleaner is abutted when the latent image former starts to form the latent image.

30. The image forming apparatus as set forth in claim 29, wherein the toner supplier supplies the toner while the developing roller is separated from the image carrier.

31. The image forming apparatus as set forth in claim 29, wherein the supplied toner is a dummy toner image formed on the first transfer member.

32. The image forming apparatus as set forth in claim 31, further comprising:

a second transfer member, which secondarily transfer the toner image from the first transfer member onto a recording medium; and a second cleaner, operable to remove toner remained on the first transfer member, the second cleaner being separated from the first transfer member so as to avoid the dummy toner image.

33. The image forming apparatus as set forth in claim 29, wherein the toner supplier is a circulator which returns the toner removed by the first cleaner onto the image carrier.

34. The image forming apparatus as set forth in claim 33, wherein the circulator is a rotary brush.

35. The image forming apparatus as set forth in claim 29, wherein the developing roller is mounted on a rotary unit operable to move the developing roller in a circumferential direction thereof, thereby separating the developing roller from the image carrier.

36. The image forming apparatus as set forth in claim 35, wherein the rotary unit comprises a plurality of cartridges each of which contains one color of toner different from another and is provided with the developing roller.

37. The image forming apparatus as set forth in claim 29, wherein the first cleaner comprises a blade member which is pivotable about a point situated further from the image carrier relative to a tangential line defined at an abutting point between the blade member and to the image carrier.

38. An image forming apparatus, comprising:

a rotary image carrier, a latent image former, which forms an electrostatic latent image on the image carrier;

a developing roller, separatably abutted on the image carrier at a first circumferential position thereof to supply toner onto the image carrier to make the latent image visible as a toner image;

a transfer member, on which the toner image is transferred;

a cleaner, abutted on the image carrier at a second circumferential position thereof to remove toner remained thereon; and a controller, which causes the latent image former to start to form the latent image after the toner supplied from the developing roller reaches the second circumferential position.

39. The image forming apparatus as set forth in claim 38, wherein the controller includes a detector which detects whether the toner is absent at the second circumferential position.

40. The image forming apparatus as set forth in claim 39, wherein the controller inhibits the latent image formation when the detects that the toner is absent at the second circumferential position.

41. The image forming apparatus as set forth in claim 39, wherein the detector detects whether the toner is absent at the first portion based on a fact that the developing roller is abutted on a portion of the image carrier placed at the second circumferential position when the portion was placed at the first circumferential position.

42. The image forming apparatus as set forth in claim 39, wherein the detector detects whether the toner is absent at the first portion based on a fact that a dummy toner image is formed on a portion of the transfer member that opposes a portion of the image carrier which was placed at the first circumferential position while the developing roller is separated from the image carrier.

43. The image forming apparatus as set forth in claim 38, wherein the developing roller is mounted on a rotary unit operable to move the developing roller in a circumferential direction thereof, thereby separating the developing roller from the image carrier.

44. The image forming apparatus as set forth in claim 43, wherein the rotary unit comprises a plurality of cartridges each of which contains one color of toner different from another and is provided with the developing roller.

45. The image forming apparatus as set forth in claim 38, wherein the cleaner comprises a blade member which is pivotable about a point situated further from the image carrier relative to a tangential line defined at an abutting point between the blade member and to the image carrier.

* * * * *